US007909714B2

(12) United States Patent
Cyr et al.

(10) Patent No.: US 7,909,714 B2
(45) Date of Patent: Mar. 22, 2011

(54) REAR MOUNTED PENETRATION LIMITER FOR BOW-FIRED PROJECTILES

(76) Inventors: Maurice Cyr, Hampden, ME (US); Jon Simms, Hampden, ME (US)

( * ) Notice: Subject to any disclaimer, the term of this patent is extended or adjusted under 35 U.S.C. 154(b) by 394 days.

(21) Appl. No.: 11/839,386

(22) Filed: Aug. 15, 2007

(65) Prior Publication Data

US 2008/0248904 A1 Oct. 9, 2008

Related U.S. Application Data

(63) Continuation-in-part of application No. 11/697,165, filed on Apr. 5, 2007.

(51) Int. Cl.
*F42B 6/04* (2006.01)

(52) U.S. Cl. ..... 473/578; 473/586

(58) Field of Classification Search ..... 473/578, 473/585, 586

See application file for complete search history.

(56) References Cited

U.S. PATENT DOCUMENTS

| | | | | |
|---|---|---|---|---|
| 3,417,994 | A * | 12/1968 | Rohrbaugh, Jr. | 473/577 |
| 3,865,374 | A | 2/1975 | Troncoso, Jr. | |
| 4,204,307 | A * | 5/1980 | Pfetzing | 29/407.09 |
| 4,651,999 | A | 3/1987 | Sturm | |
| 4,795,165 | A | 1/1989 | Tehan | |
| 4,836,557 | A | 6/1989 | Polando | |
| 5,022,658 | A | 6/1991 | Burkhart | |
| 5,427,384 | A | 6/1995 | Saunders | |
| 5,496,041 | A | 3/1996 | Broussard | |
| 5,553,413 | A * | 9/1996 | Gannon | 43/6 |
| 5,897,449 | A * | 4/1999 | Roberts et al. | 473/586 |
| 6,517,453 | B2 | 2/2003 | LaSee | |
| 6,695,727 | B1 * | 2/2004 | Kuhn | 473/586 |
| 6,764,420 | B2 | 7/2004 | Cyr et al. | |
| 6,811,503 | B2 | 11/2004 | May et al. | |
| 6,814,678 | B2 | 11/2004 | Cyr et al. | |
| 7,331,886 | B2 | 2/2008 | Morris et al. | |
| 2003/0045381 | A1 | 3/2003 | Morris et al. | |

OTHER PUBLICATIONS

"Wild Turkey Hunting Tip", www.bowhunting.net/NAspecies/wturk-hunttechnique.htm.
"Bowhunting Gear Turkeys", www.huntingnet.com/staticpages/staticpage_detail.aspx?i.
"Arrow Components".
"3Rivers Archery", www.3riversarchery.com/Product.asp/c=10&s=43&p=86&i=.
J. Cetacean Res. Manage, 2000, "First Report of dolphin death"2(3):217-221.

* cited by examiner

*Primary Examiner* — John Ricci
(74) *Attorney, Agent, or Firm* — Anthony D. Pellegrini, Esquire

(57) ABSTRACT

A rear mounted penetration limiter for bow-fired projectiles for use in combination with a projectile and a nock, wherein said projectile is an arrow or a crossbow bolt, said penetration limiter comprising an attachment component, a nock securing component, and an engagement component having one or more engagement members, with said penetration limiter suitably adapted to limit the penetration of the projectile through a game animal once the front end of the projectile has struck and passed through the game animal, thereby allowing the creation of an exit wound while retaining the projectile within the game animal. In one embodiment the penetration limiter is adapted to detach from the projectile, remaining secured thereto by a short tether, thereby allowing the detached penetration limiter to reorient itself within the game animal to create greater drag on the projectile.

13 Claims, 6 Drawing Sheets

REAR MOUNTED PENETRATION LIMITER FOR BOW-FIRED PROJECTILES

CROSS REFERENCE TO RELATED APPLICATION

This application is a continuation in part of U.S. Ser. No. 11/697,165, filed Apr. 5, 2007 and currently pending, entitled Game Animal Escape Impedance Device, by Cyr, Maurice, et al., which is hereby incorporated by reference.

BACKGROUND OF THE INVENTION

1. Technical Field

The present invention relates generally to the field of bow hunting for game animals and more particularly to an improved penetration limiter device used in combination with an arrow or crossbow bolt to limit the degree of penetration of same into and through a game animal.

2. Description of Prior Art

Within the sport of bow hunting devices known as penetration limiters are well known. Penetration limiters serve to limit the movement of an arrow shaft through a target, typically a game animal. Absent the use of a penetration limiter, an arrow often will pass completely through a game animal; while in some cases this is desirable, so as to leave a blood trail for easier tracking, in other cases, such as when bow hunting turkeys, a pass-through shot is undesired.

A penetration limiter typically consists of a projection or projections which depend at an angle from the longitudinal axis of the arrow shaft. In the most common embodiment, penetration limiters are solid disks which are placed directly behind the broadhead or field point of an arrow. The disks are oriented generally perpendicular to the longitudinal axis of the arrow shaft. The disks may either be fixedly attached to the arrow or movably attached; when fixedly attached, contact of the disk with the game animal immediately stops further penetration of the arrow through the game animal, while when movably attached the arrow will continue to pass through the game animal after contact of the disk with the game animal, but its flight will be slowed as the disk moves rearward along the arrow shaft. Neither of these configurations is ideal. While a fixedly attached disk allows the bow hunter to control the degree of penetration of the arrow, often the arrow fails to penetrate to a sufficient depth for a clean kill, or simply falls out. With a movably attached disk, the degree of penetration is less certain, and the arrow may continue to move completely through and out of the game animal. In both configurations the disk itself impedes the flight of the arrow, creating wind resistance and interfering with distance and accuracy of the shot.

Other embodiments of penetration limiters disclosed in the art include forward oriented hooks or prongs located behind the broadhead or field point. These may be rigid or flexible. A common design incorporates springs with the prongs, such that the prongs have a lower profile during flight and then expand outward from the shaft upon contact with the game animal. While such a configuration improves the flight characteristics of the arrow, the deficiencies resulting from the forward placement of the devices on the arrow shafts remain.

A penetration limiter mounted at the rear of an arrow shaft ensures that a sufficient amount of penetration of the arrow will occur. However, rear mounted penetration limiters known in the art interfere with the shooting of the arrow. They prevent the use of a standard arrow rest, because the penetration limiter will catch on the rest as the arrow is released from the bow, and instead require the use of a fall-away rest. Many bow hunters disfavor the use of fall-away rests, however, limiting the acceptability of known rear mounted penetration limiters.

There is therefore a need for an improved penetration limiter mountable on the rear of a bow-fired projectile for limiting the penetration of said projectile into and through a game animal, whereby the improved penetration limiter may be used with standard shafts and standard rests.

It is therefore an objective of this invention to provide an improved penetration limiter mountable on the rear of a bow-fired projectile for limiting the penetration of said projectile into and through a game animal.

It is a further objective of this invention to provide an improved penetration limiter mountable on the rear of a bow-fired projectile which allows bow hunters to use their preferred model of shaft, fletching, arrowhead, and arrow rest.

It is yet a further objective of this invention to provide an improved penetration limiter mountable on the rear of a bow-fired projectile having a minimum impact on the range and accuracy of the projectile in flight.

It is yet a further objective of this invention to provide an improved penetration limiter mountable on the rear of a bow-fired projectile which is easy to use in the field.

It is yet a further objective of this invention to provide an improved penetration limiter mountable on the rear of a bow-fired projectile which is easy and inexpensive to manufacture.

It is yet a further objective of this invention to provide an improved penetration limiter mountable on the rear of a bow-fired projectile which deploys from the projectile shaft upon contact with a game animal to present a greater profile for increased resistance to travel.

It is yet a further objective of this invention to provide an improved penetration limiter mountable on the rear of a bow-fired projectile which may be used with a game animal escape impedance device.

Other objectives of this invention will be evident from the following disclosure.

SUMMARY

The present invention is directed to an improved penetration limiter mountable on the rear of a bow-fired projectile for use when bow hunting game animals. The projectile may be either an arrow that is shot with a bow, or a bolt that is shot with a crossbow. The penetration limiter comprises an attachment component for securing it to the projectile, a nock securing component for securing a standard nock to the penetration limiter, and an engagement component for securing the penetration limiter to a game animal. Upon the projectile striking the game animal and the front end of the projectile passing through and out of the game animal, the penetration limiter contacts the game animal and engages therewith, thereby limiting further penetration of the projectile through the game animal.

In one embodiment the penetration limiter is removably attached to the back end of the projectile, with a tether employed to retain the penetration limiter to the projectile after detachment. This allows for a relatively low profile penetration limiter to be used, thus minimizing its impact on the range and accuracy of the projectile in flight. When the penetration limiter detaches from the projectile upon contacting the game animal, this configuration allows the penetration limiter to alter its orientation relative to the projectile, thereby presenting a broader profile of the penetration limiter within the game animal to exert greater stopping forces on the projectile than could otherwise be achieved with a low profile penetration limiter.

In another embodiment the engagement component of the penetration limiter is removable. This allows for easy maintenance and replacement of the engagement component, or for the simple exchange of the engagement component if a different style is desired.

Other features and advantages of the invention are described below.

DETAILED DESCRIPTION OF THE INVENTION

Figure 1:
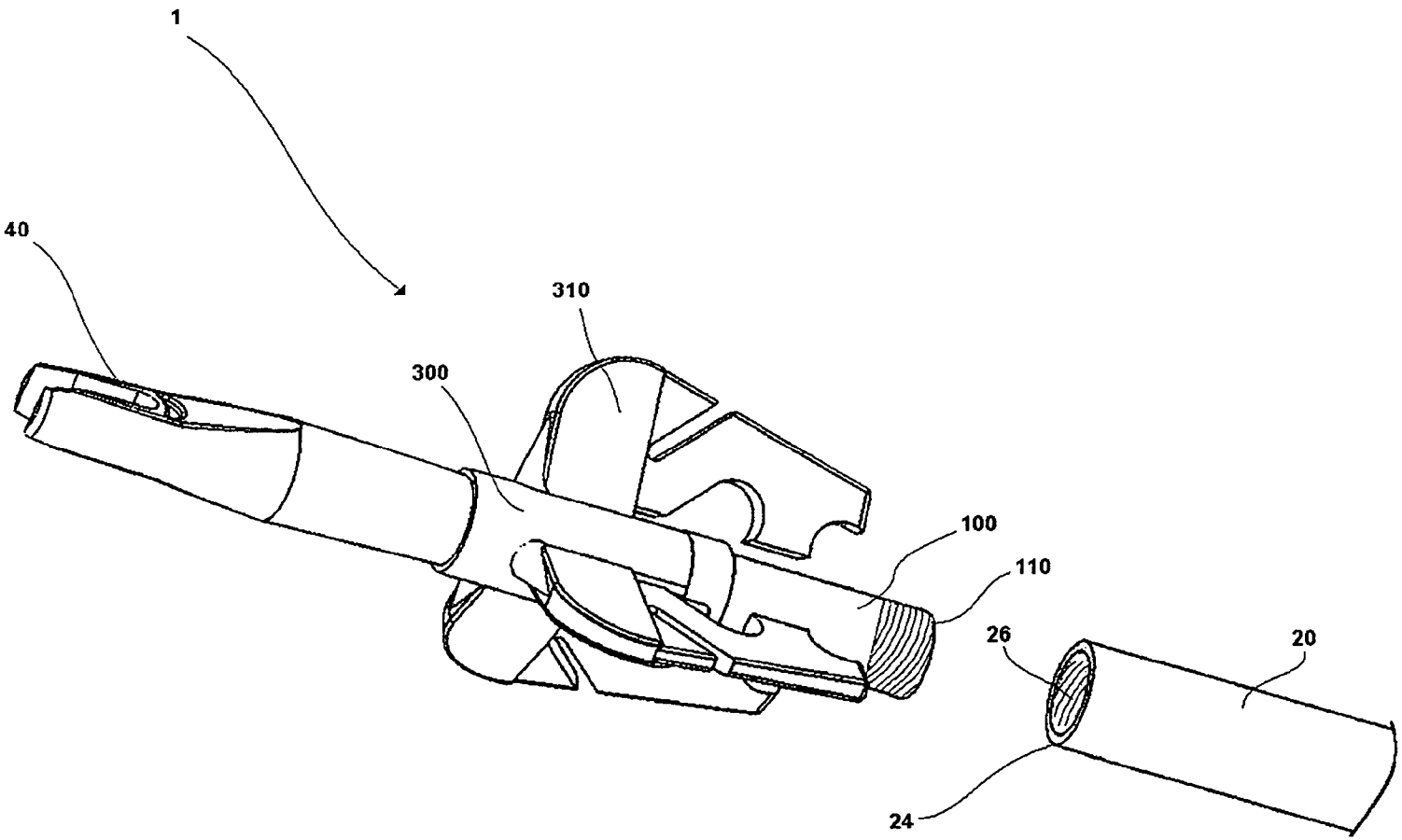
FIG. 1 is a perspective view of the present invention.

The present invention comprises a penetration limiter 1 for use in combination with a projectile 20 and a nock 40. The projectile 20 is either an arrow or a cross bow bolt, and has a shaft with an outside diameter, a front end 22, a back end 24, and an aperture 26 formed into the back end 24. The projectile 20 may carry any type of broadhead or field point at the front end 22, and may have standard fletching or other flight stabilization devices associated therewith, as desired. The projectile 20 may be any standard arrow or cross bow bolt having the aforementioned characteristics. The nock 40 may be any standard nock 40 used with archery projectiles 20. The projectile 20 may be shot from any standard bow or cross bow; when shot from a bow, a standard arrow rest may be used. The penetration limiter 1 of the present invention thus may be used with standard archery equipment without need for customization by the user.

Figure 2:
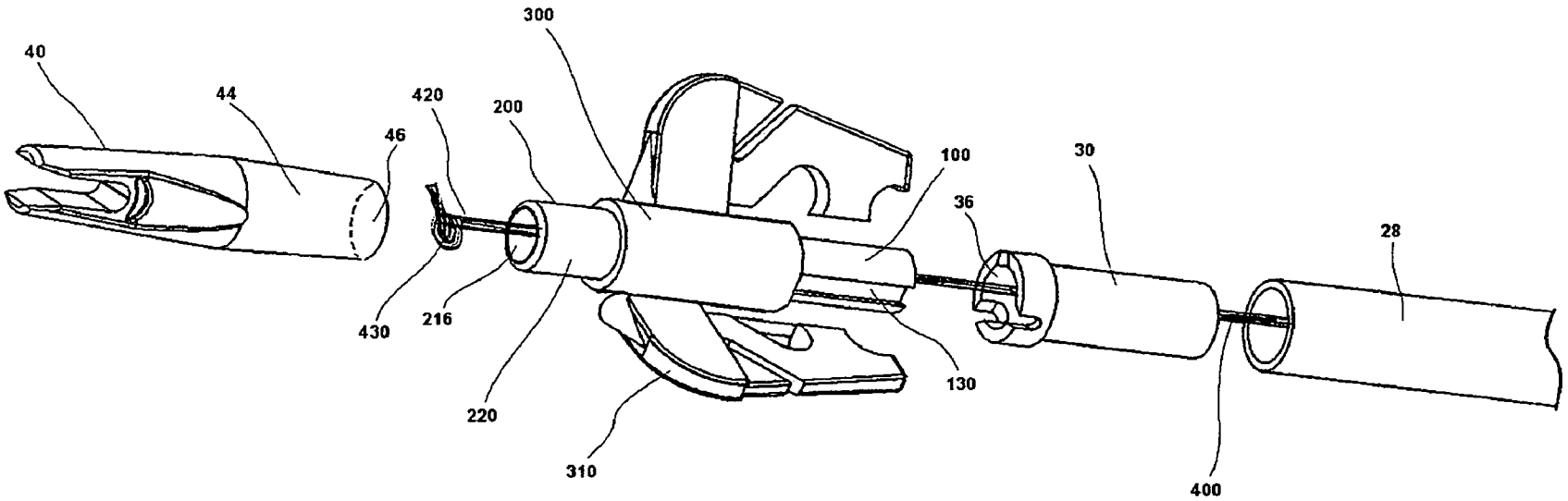
FIG. 2 is an exploded perspective view of the present invention.
Figure 6:
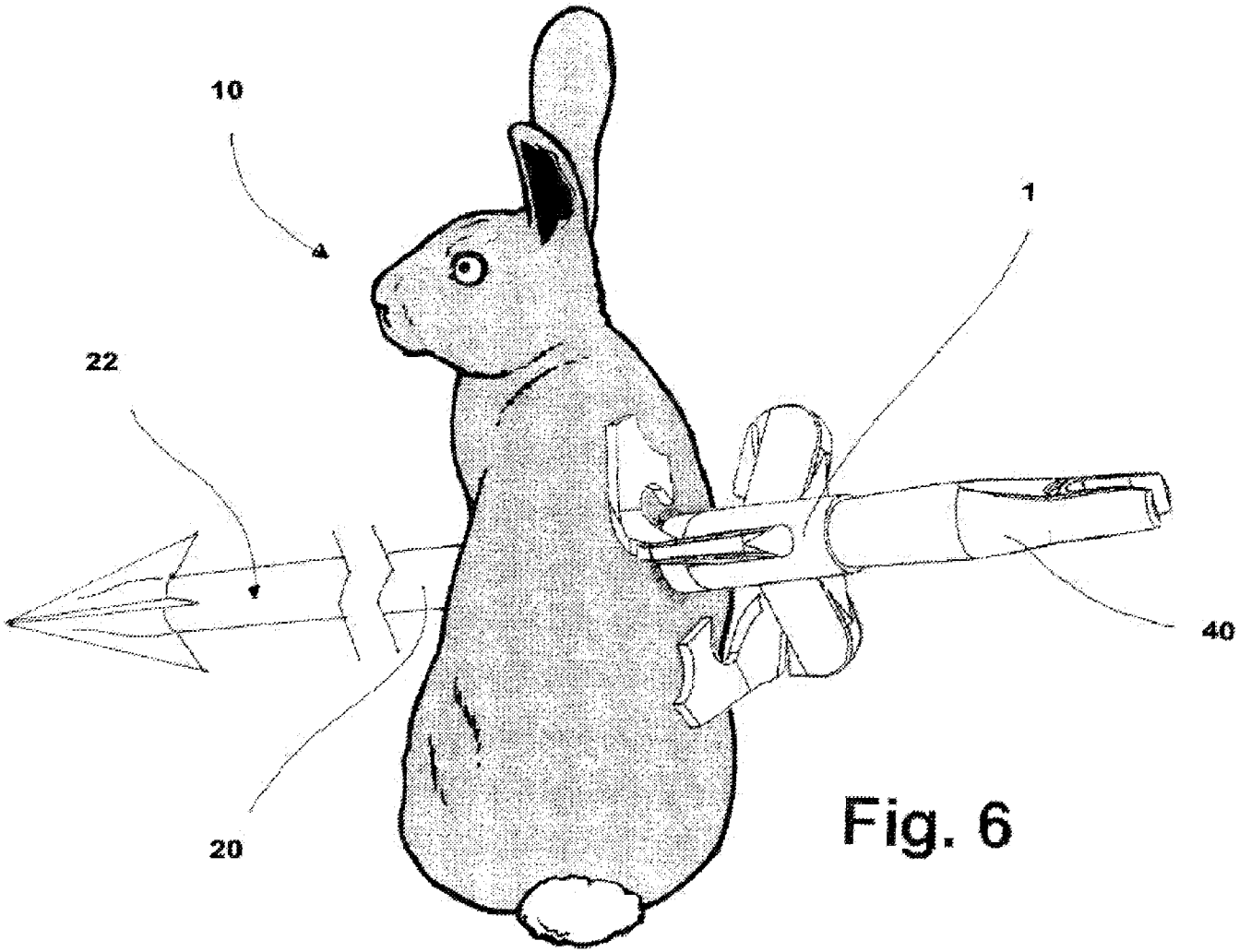
FIG. 6 is a view of the present invention in use with a game animal.

The penetration limiter 1 comprises an attachment component 100, a nock securing component 200, and an engagement component 300. See FIG. 2. The attachment component 100 is suitably adapted to attach the penetration limiter 1 to the back end 24 of the projectile 20, the nock securing component 200 is suitably adapted to attach the nock 40 to the penetration limiter 1, and the engagement component 300 is suitably adapted to engage the penetration limiter 1 with a game animal 10. When used as intended, the penetration limiter 1 is attached to the back end 24 of the projectile 20 and the projectile 20 is shot from a bow or cross bow at a game animal 10. Upon the projectile 20 striking a game animal 10, the front end 22 of the projectile 20 passes through and out of the game animal 10 and the penetration limiter 1 contacts the game animal 10. See FIG. 6. The engagement component 300 of the penetration limiter 1 engages with the game animal 10, thereby limiting further penetration of the projectile 20 through the game animal 10. Engagement of the penetration limiter 1 may be with the outer hide of the game animal 10, or with internal structures, such as muscle, bone, fascia, and the like. By being attached to the back end 24 of the projectile 20, the penetration limiter 1 allows full penetration by the front end 22 of the projectile 20 through the game animal 10.

The attachment component 100 of the penetration limiter 1 is aligned substantially along the longitudinal axis of the projectile 20. It has an elongated prong 110 suitably adapted to be fitted into the aperture 26 formed into the back end 24 of the projectile 20 to attach the penetration limiter 1 to the projectile 20. The attachment component 100 may be fixedly attached to the projectile 20. This may be accomplished by use of an adhesive. If the back end 24 of the projectile 20 is threaded the elongated prong 110 may have threads so as to be screwed into the aperture 26. See FIG. 1. In the preferred embodiment the attachment component 100 is removably attached to the projectile 20. Removal is accomplished by inertial forces acting on the penetration limiter 1 as the forward motion of the penetration limiter 1 becomes slowed or stopped relative to the forward motion of the projectile 20. This occurs once the penetration limiter 1 has engaged with the game animal 10. This causes the projectile 20 to separate from the penetration limiter 1 and continue its forward motion.

In the embodiments of the present invention comprising a removable penetration limiter 1, the attachment component 100 may be frictionally attached to the back end 24 of the projectile 20, mechanically attached to the back end 24 of the projectile 20, or magnetically attached to the back end 24 of the projectile 20. In any such configuration, the attachment component 100 must be suitably secured to the back end 24 of the projectile 20 to retain the penetration limiter 1 to the projectile 20 during the flight of the projectile 20, but the securing forces must be overcome by the inertial forces acting on the penetration limiter 1 and the projectile 20 upon the game animal 10 being struck with the projectile 20.

In one embodiment the elongated prong 110 of the attachment component 100 may be frictionally attached to the back end 24 of the projectile 20 by the elongated prong 110 being snugly inserted into the aperture 26 formed in the back end 24 of the projectile 20. The elongated prong 110 may have an outside diameter just slightly smaller than the inside diameter of the aperture 26 or the elongated prong 110 may have a tapered shape. The elongated prong 110 and/or the interior of the aperture 26 may also be coated with a material to increase the friction between the two.

The elongated prong 110 of the attachment component 100 alternatively may be mechanically attached to the back end 24 of the projectile 20. This may be accomplished by any known means. In one configuration the elongated prong 110 has an annular projection adapted to fit into an annular depression formed within the aperture 26 of the projectile 20. In another configuration an annular projection may be formed within the aperture 26 of the projectile 20 and an annular depression may be formed into the elongated prong 110. In yet another configuration a mechanical attachment is achieved by use of a ball detent in the elongated prong 110 with a corresponding depression in the aperture 26. Other means for frictionally or mechanically attaching the attachment component 100 to the projectile 20 as are known in the art are also contemplated by the present invention.

In yet another embodiment a magnet is attached to the attachment component 100 and a magnetically attractive material is attached to the back end 24 of the projectile 20. In yet another embodiment a magnetically attractive material is attached to the attachment component 100 and a magnet is attached to the back end 24 of the projectile 20. Other means for frictionally, mechanically, or magnetically attaching the penetration limiter 1 to the projectile 20 as are known in the art are also contemplated by the present invention.

In the embodiments of the present invention in which the attachment component 100 of the penetration limiter 1 is removably attached to the projectile 20, the penetration limiter 1 further comprises a tether 400. The tether 400 has a first end and a second end 420, wherein the tether 400 is suitably adapted to attach the penetration limiter 1 to the projectile 20, with the first end of the tether 400 secured to the projectile 20 and the second end 420 of the tether 400 secured to the penetration limiter 1. Upon impact of the projectile 20 with the game animal 10, the front end 22 of the projectile 20 passes through the game animal 10, the engagement component 300 impacts the game animal 10 and becomes secured thereto, inertial forces cause the penetration limiter 1 to detach from the projectile 20, thereby deploying the tether 400, and the fully deployed tether 400 halts further forward motion of the projectile 20. The tether 400 must be able to withstand without breaking the inertial forces detaching the penetration limiter 1 from the game animal 10. In one embodiment the tether 400 is made of braided Dacron. In the preferred embodiment the tether 400 is shorter than the length of the shaft of the projectile 20, preferably between six inches and eighteen inches in length. This allows the projectile 20 to penetrate the game animal 10 but not to fully emerge from the resulting exit wound, thus retaining the projectile 20 partially within the game animal. In another embodiment the tether 400 is coated with a wax. This stiffens the tether 400 and serves to waterproof it.

In the foregoing embodiments the projectile 20 may have a hollow shaft 28, within which the tether 400 is stored prior to deployment. As the projectile 20 separates from the penetration limiter 1, the tether 400 is pulled out of the hollow shaft 28 of the projectile 20. This configuration securely retains the tether 400 prior to deployment, preventing the tether 400 from becoming entangled or otherwise interfering with the use or storage of the projectile 20. More importantly, with the tether 400 contained within the hollow shaft 28 of the projectile 20, the tether 400 does not interfere with the flight of the projectile 20.

Figure 5:
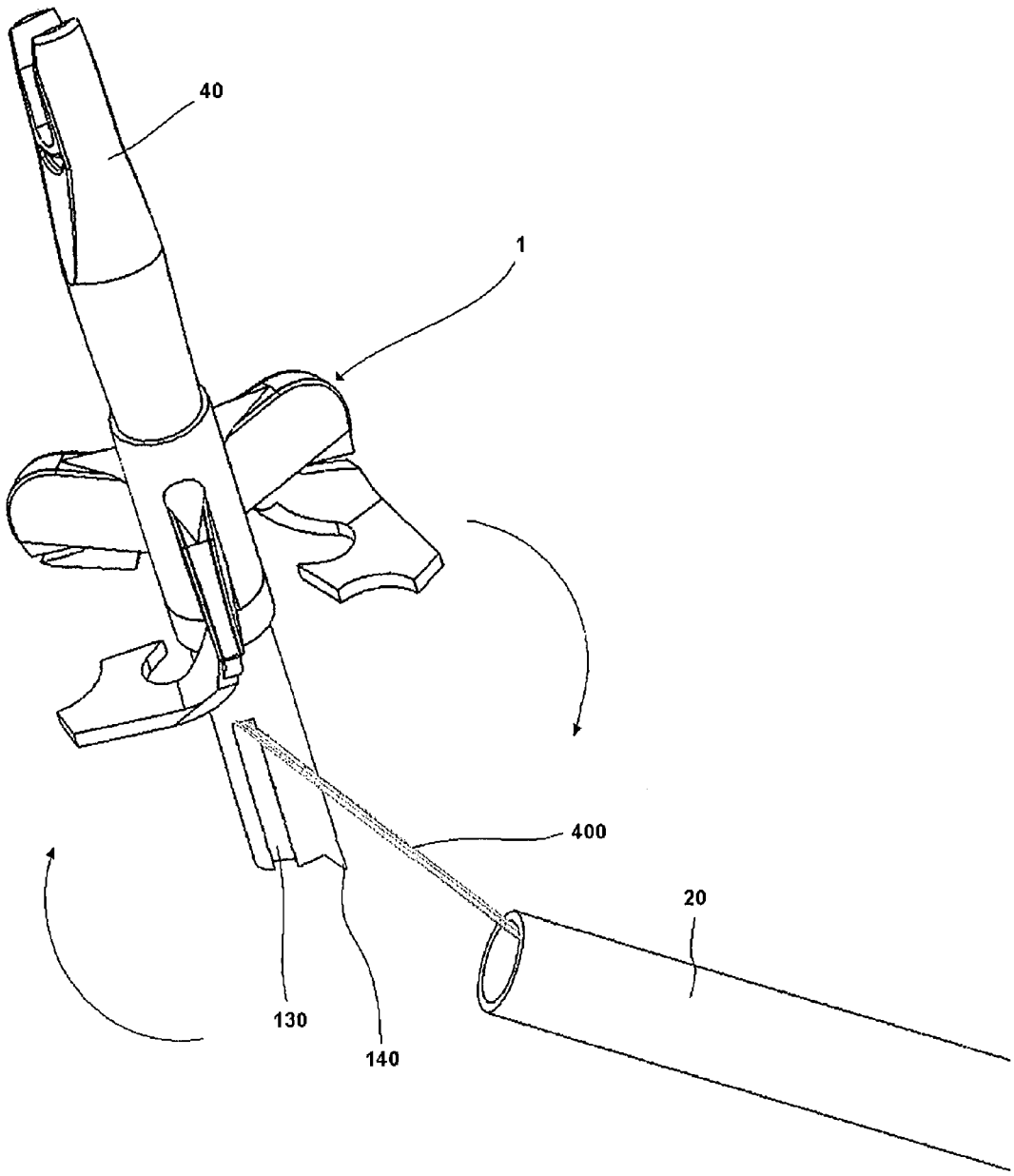
FIG. 5 is a perspective view of the present invention showing the disengagement of the penetration limiter from the projectile and subsequent rotation thereof.

The use of a removably attachable attachment component 100 allows the penetration limiter 1 to alter its orientation relative to the projectile 20 upon detachment. This allows the penetration limiter 1 to have a relatively low profile during the flight of the projectile 20, while also allowing the penetration limiter 1 to have a broader profile, and thus greater stopping capabilities, upon engagement with the game animal 10. For example, a substantially elongate penetration limiter 1 will offer the least amount of wind resistance to the projectile 20 during flight, thereby minimizing the effects of its use on the distance and accuracy of the shot. Upon contact with the game animal 10, the penetration limiter 1 detaches from the projectile 20 and rotates within the body of the game animal 10, aligning itself substantially perpendicular to the projectile 20. See FIG. 5. The entire length of the penetration limiter 1 then acts to halt the forward motion of the projectile 20.

Figure 3:
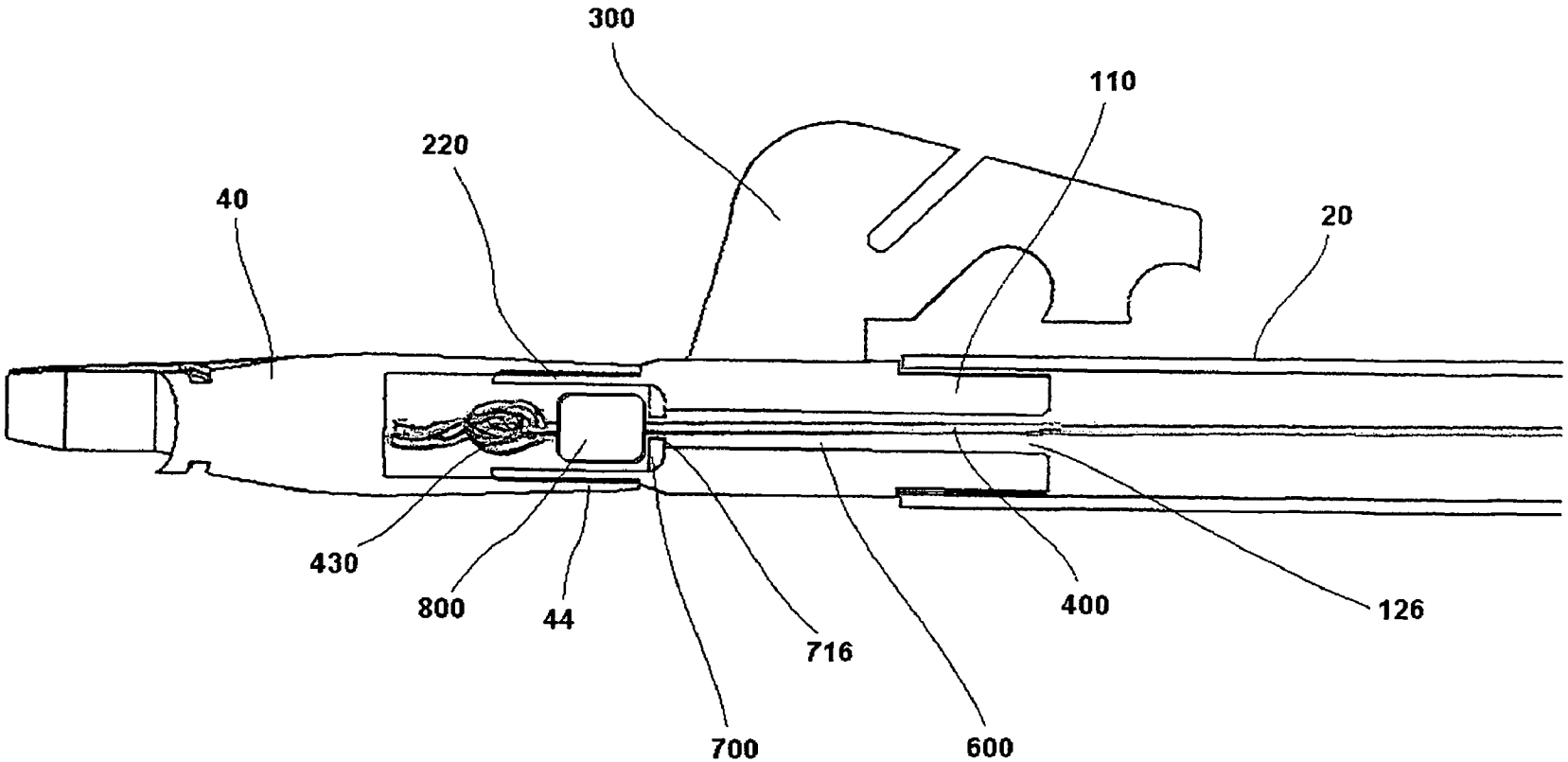
FIG. 3 is a cut-away partial plan view of the present invention showing an alternative means for attaching the penetration limiter to the projectile.

In one embodiment intended to achieve the foregoing effect, the attachment component 100 comprises a central aperture 126 formed into and through the elongated prong 110. See FIG. 3. The central aperture 126 is aligned along the longitudinal axis of the elongated prong 110, thereby making the elongated prong 110 hollow with an open font end. The attachment component 100 also comprises an exit slot 130. See FIG. 2. The exit slot 130 is formed into a side of the elongated prong 110 and is in communication with the central aperture 126. The exit slot 130 is also aligned along the longitudinal axis of the elongated prong 110 and is opened at the front end of the elongated prong 110. The second end 420 of the tether 400 is passed into and through the central aperture 126 of the attachment component 100, resulting in a portion of the tether 400 being contained within the attachment component 100. Upon detachment of the penetration limiter 1 from the projectile 20 and deployment of the tether 400, the penetration limiter 1 deflects from the direction of travel of the projectile 20. The portion of the tether 400 contained within the central aperture 126 of the attachment component 100 exits the attachment component 100 through the exit slot 130, allowing the penetration limiter 1 to continue to change its orientation relative to the projectile 20, as described above. In other words, the penetration limiter 1 pivots on contact with the game animal 10, with the pivot point being the point of contact between the tether 400 and the rear of the exit slot 130. See FIG. 5.

Figure 4:
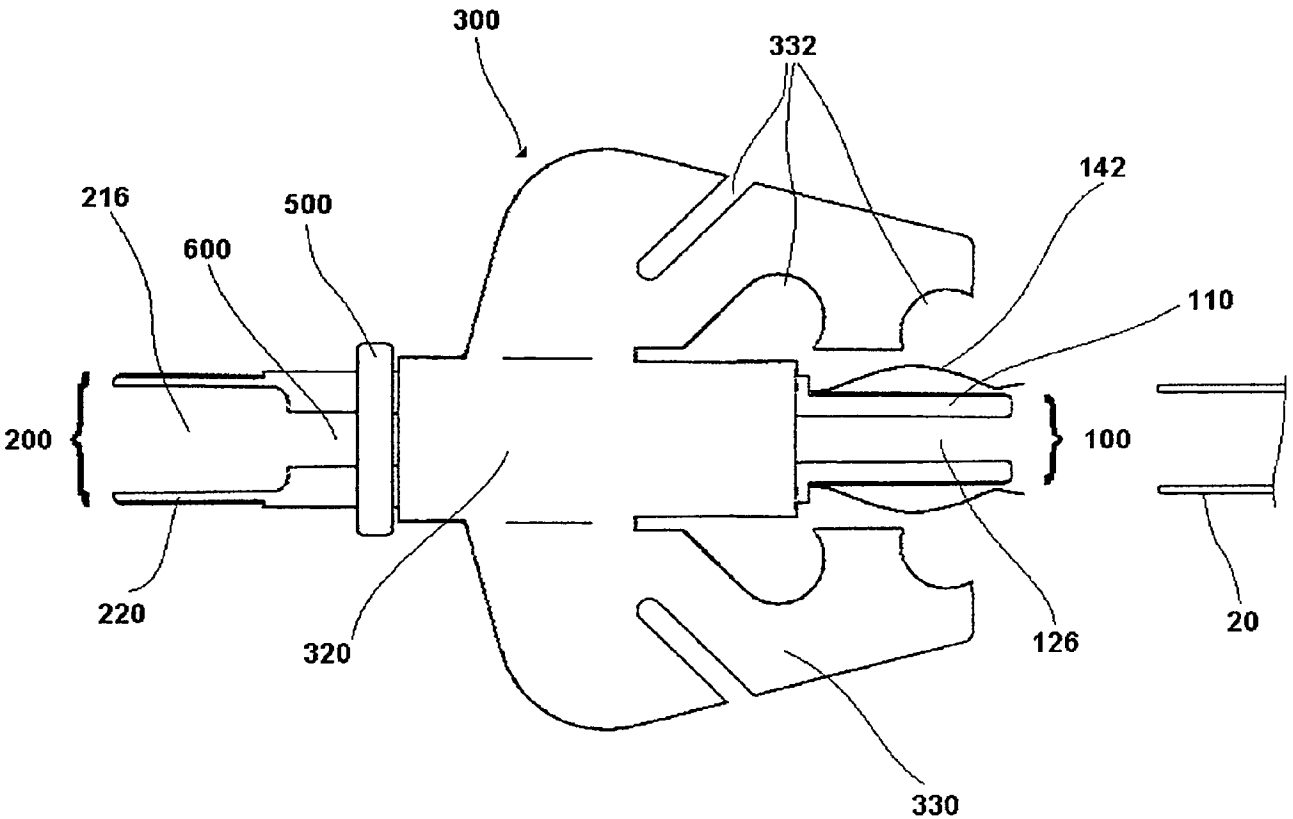
FIG. 4 is a plan view of an alternative embodiment of the present invention.

In order to assist with the deflection of the penetration limiter 1, as described above, the attachment component 100 may comprise one or more deflection members 140. The deflection members 140 are suitably adapted to engage with the game animal 10 when the penetration limiter 1 is detached from the projectile 20 upon impact with the game animal 10, thereby facilitating the deflection of the penetration limiter 1 from the direction of travel of the projectile 20. The deflection members 140 may be fixed prongs or hooks having a forward orientation, and disposed asymmetrically about the perimeter of the attachment component 100. In the preferred embodiment a sole deflection member 140 is used. See FIG. 5. In yet another embodiment the deflection members 140 are retractable grappling arms 142, whereby each grappling arm 142 has an undeployed state and a deployed state. See FIG. 4. In the undeployed state the grappling arm 142 exhibits a relatively low profile to the attachment component 100, and in the deployed state the grappling arm 142 extends laterally from the attachment component 100 relative to the undeployed state. The grappling arms 142 are suitably adapted to remain undeployed during the flight of the projectile 20 and to deploy after the penetration limiter 1 detaches from the projectile 20. The grappling arms 142 may comprise hooks, barbs, or other projections. The grappling arms 142 may be fashioned of a deformable material having "memory". In one such embodiment the grappling arms 142 are constructed of curved metal spring material and are attached to the elongated prong 110 of the attachment component 100. The grappling arms 142 are suitably adapted to be inserted into the back end 24 of the projectile 20 along with the elongated prong 110 when the penetration limiter 1 is attached to the projectile 20, where they remain relatively flat against the elongated prong 110. Upon detachment of the penetration limiter 1, the grappling arms 142 are withdrawn from the projectile 20 and spring back to their original shape, thus achieving the deployed state. In another embodiment the grappling arms 142 are pivotally attached to the penetration limiter 1. Inertial forces cause the grappling arms 142 to move from the undeployed state to the deployed state. In yet another embodiment springs may be used to move the retractable grappling arms 46 from the undeployed state to the deployed state. Other configurations of the grappling arms 142 are also contemplated.

The tether 400 may be attached to the penetration limiter 1 in any number of ways. In one embodiment the nock securing component 200 comprises a central aperture 216. The central aperture 216 is formed into and through the nock securing component 200 along the longitudinal axis of the nock securing component 200, with the central aperture 216 of the nock securing component 200 being in communication with the central aperture 126 of the attachment component 100. As a result, the central aperture 216 of the nock securing component 200 and the central aperture 126 of the attachment component 100 form a continuous passage 600 through the interior of the penetration limiter 1, substantially along the longitudinal axis of the penetration limiter 1. See FIG. 3. In one configuration the inside diameter of the central aperture 216 of the nock securing component 200 is greater than the inside diameter of the central aperture 126 of the attachment component 100. In this configuration the second end 420 of the tether 400 is passed into and through the continuous passage 600 and then a knot 430 is formed into the second end 420 of the tether 400. See FIG. 2. The knot 430 has a diameter smaller than the inside diameter of the central aperture 216 of the nock securing component 200 and larger than the inside diameter of the central aperture 126 of the attachment component 100, such that the knot 430 fits within the central aperture 216 of the nock securing component 200 but cannot pass through the central aperture 126 of the attachment component 100. In this configuration the tether 400 is retained to the penetration limiter 1 by the knot 430. In another configuration a bead 800 is placed over the second end 420 of the tether 400 after the second end 420 of the tether 400 is inserted into and through the continuous passage 600, and then the knot 430 is formed into the second end 420 of the tether 400. See FIG. 3. The bead 800 has a diameter smaller than the inside diameter of the central aperture 216 of the nock securing component 200 and larger than the inside diameter of the central aperture 126 of the attachment component 100, such that the bead 800 fits within the central aperture 216 of the nock securing component 200 but cannot pass through the central aperture 126 of the attachment component 100. In this configuration the tether 400 is retained to the penetration limiter 1 by the bead 800.

In yet another configuration the inside diameters of the central aperture 216 of the nock securing component 200 and the central aperture 126 of the attachment component 100 are substantially the same, but located within the continuous passage 600 is an annular restrictor 700. The annular restrictor 700 has an aperture 716. The annular restrictor 700 is suitably adapted to obstruct the continuous passage 600 except for the aperture 716, with the aperture 716 being just slightly larger than the thickness of the tether 400. The second end 420 of the tether 400 is passed into and through the continuous passage 600 and through the aperture 716 of the annular restrictor 700, with a knot 430 formed into the second end 420 of the tether 400 thereafter, such that the knot 430 fits within said continuous passage 600 but cannot pass through the aperture 716 of the annular restrictor 700. Alternatively, a bead 800 may be used to retain the second end 420 of the tether 400 to the penetration limiter 1, as described above. Other means for retaining the tether 400 to the penetration limiter 1 as may be known in the art are also contemplated by the present invention.

The nock securing component 200 of the penetration limiter 1 is suitably adapted to attach a standard nock 40 to the penetration limiter 1. The nock securing component 200 is aligned substantially along the longitudinal axis of the projectile 20. In one embodiment, where the nock 40 comprises a forward aperture 46, the nock securing component 200 comprises an elongated prong 220 suitably adapted to be fitted into the forward aperture 46 of the nock 40. The nock 40 may be frictionally attached to the nock securing component 200 or may be fixedly attached to the nock securing component 200, such as with an adhesive. In another embodiment, where the nock 40 comprises a forward prong 44, the nock securing component 200 comprises a central aperture 216. The central aperture 216 is formed into the nock securing component 200 along the longitudinal axis of the nock securing component 200, and is suitably adapted to receive the forward prong 44 of the nock 40. The forward prong 44 of the nock 40 may be frictionally attached to the nock securing component 200 or may be fixedly attached to the nock securing component 200, such as with an adhesive.

The engagement component 300 is suitably adapted to engage with a game animal 10 and become secured thereto. The engagement component 300 comprises one or more engagement members 310. See FIG. 1. The engagement members 310 may be hooks, barbs, fins, plates, disks, or any other type of projection depending from the penetration limiter 1 and which are suitably adapted to engage the game animal 10. In one embodiment the engagement member 310 is a flexible flange 330. See FIG. 4. The flange 330 is substantially planar and substantially elongate, and oriented towards the front end 22 of the projectile 20. In one embodiment the flange 330 has a contoured perimeter 332, with the contours suitably adapted to increase the likelihood of the flange 330 engaging with the game animal 10. In the preferred embodiment the engagement component 300 comprises multiple flanges 330. Each of the flanges 330 may be contoured as described above. In another embodiment the engagement component 300 comprises a forward oriented treble hook. In yet another embodiment the engagement component 300 comprises one or more grappling arms 142 configured as described above.

In another embodiment the engagement component 300 is removably attached to the attachment component 100. This permits easy replacement if the engagement component 300 is damaged during use, or if a differently configured engagement component 300 is desired. In one such embodiment, to accommodate the removable engagement component 300 the penetration limiter 1 further comprises an annular ridge 500. See FIG. 4. The annular ridge 500 extends circumferentially from the penetration limiter 1 between the attachment component 100 and the nock securing component 200. The annular ridge 500 is oriented substantially perpendicularly to the longitudinal axis of the projectile 20. The outside diameter of the annular ridge 500 is not greater than the outside diameter of the projectile 20. The engagement component 300 in turn comprises a ring 320, wherein one or more engagement members 310 are attached to and disposed about the ring 320. See FIG. 4. The ring 320 is suitably adapted to be placed over the attachment component 100 and against the annular ridge 500. The ring 320 has an outside diameter not greater than the outside diameter of the projectile 20 and an inside diameter smaller than the outside diameter of the annular ridge 500. The engagement component 300 is removably attached to the penetration limiter 1 by placing the ring 320 onto the attachment component 100 and against the annular ridge 500, and is secured between the annular ridge 500 and the back end 24 of the projectile 20 when the attachment component 100 is attached to the projectile 20. Where the penetration limiter 1 is removably attached to the projectile 20, the engagement component 300 may slip off the attachment component 100 when the penetration limiter 1 separates from the projectile 20, but the engagement component 300 will remain interposed between the penetration limiter 1 and the projectile 20 by the tether 400 and thus will continue to provide engagement functionality.

In one embodiment the projectile 20 comprises a bushing 30. See FIG. 2. The bushing 30 is suitably adapted to be inserted into the aperture 26 formed into the back end 24 of the projectile 20 and is fixedly attached thereto, typically with an adhesive. The bushing 30 has an aperture 36. The elongated prong 110 of the attachment component 100 is suitably adapted to be fitted into the aperture 36 of the bushing 30 to attach the penetration limiter 1 to the projectile 20. The attachment component 100 may be fixedly attached to the bushing 30 in the same manner as described above. The elongated prong 110 of the attachment component 100 may be frictionally attached to the bushing 30 in the same manner as described above. The elongated prong 110 of the attachment component 100 may be mechanically attached to the bushing 30 in the same manner as described above. The advantage of using a bushing 30 is to allow for a standard manufacturing process, whereby the attachment component 100 and the aperture 36 of the bushing 30 can be standardized, while the outer diameter of the bushing 30 may be varied to accommodate different styles of projectiles 20.

The nock securing component 200 and the attachment component 100 may be integrated and formed of a single body. In the preferred embodiment the nock securing component 200 and the attachment component 100 are formed of a single tube, with the internal cavity of the tube forming the continuous passage 600. The exit slot 130 is formed in the forward portion of the tube and the annular ridge 500 is formed substantially midway along the tube. The forward portion of the tube constitutes the elongated prong 110 of the attachment component, while the rearward portion of the tube constitutes the elongated prong 220 of the nock securing component 200. The tube may be constructed of a rigid plastic material, or may be formed of other materials, such as metals and alloys. In the preferred embodiment the tube is formed of aluminum. In this embodiment the engagement component 300 is removably attached to the penetration limiter 1 and incorporates the ring 320 design described above. This configuration is extremely simple and inexpensive to manufacture.

As described above in its various configurations, the penetration limiter 1 of the present invention is very easy to use in the field. Attachment of the penetration limiter 1 to the projectile 20 may be as simple as inserting the elongated prong 110 of the attachment component 100 into the aperture 26 in the back end 24 of the projectile 20. Attachment of a nock 40 to the penetration limiter 1 may be similarly straightforward. Where a removable penetration limiter 1 is used, there may entail some minimal preparation time to attach the first end of the tether 400 to the projectile 20, but this process may also be simplified. If the projectile 20 has a hollow shaft 28, the tether 400 may be inserted into the back end 24 of the projectile 20 and through the hollow shaft 28 of the projectile 20 so that the first end of the tether 400 extends beyond the front end 22 of the projectile 20. Then the first end of the tether can be secured to the arrowhead, which is then attached to the front end 22 of the projectile 20, thereby securing the first end of the tether 400 to the projectile 20. The removable engagement component 300 can then be placed onto the penetration limiter 1 and the second end 420 of the tether 400 thereafter can be secured to the penetration limiter 1 using one of the various approaches described above. The entire process may be performed in a matter of minutes, using standard archery equipment.

Having fully described the present invention, it will be appreciated by those skilled in the art that the same can be performed using equivalent structures and conditions without departing from the spirit and scope of the invention. While this invention has been described in connection with specific embodiments thereof, it will be understood that other embodiments not specifically set forth herein are also within the scope of the following claims. It will be further understood that the present invention is capable of additional modifications. This application is intended to cover any variations, uses, or adaptations of the invention following, in general, the principles of the invention and including such departures from the present disclosure as come within known or customary practice within the art to which the invention pertains and as may be applied to the essential features set forth herein as follows within the scope of the following claims.

We claim:

1. A penetration limiter for a projectile having a front end and an open rear end which is shot by an archery bow or cross bow, the penetration limiter comprising:

a) a tubular body with a front end and a rear end, the front end being secured to the rear end of the projectile;

b) one or more fletching-like flanges, each having a rear portion, mounted and radially extending from the tubular body;

c) a nock secured to the rear end of the tubular body; and d) a tether connecting the projectile and the penetration limiter;

wherein the one or more flanges are contoured to engage and not pass through an animal.

2. A penetration limiter for a projectile having a front end and an open rear end which is shot by an archery bow or cross bow, the penetration limiter comprising:

a) a tubular body with a front end and a rear end, the front end being secured to the rear end of the projectile;

b) one or more fletching-like flanges, each having a rear portion, mounted and radially extending from the tubular body;

c) a nock secured to the rear end of the tubular body; and d) a tether connecting the projectile and the penetration limiter;

wherein the one or more flanges are oriented toward the front end of the projectile.

3. A penetration limiter for a projectile having a front end and an open rear end which is shot by an archery bow or cross bow, the penetration limiter comprising:

a) a tubular body with a front end and a rear end, the front end being secured to the rear end of the projectile;

b) one or more fletching-like flanges, each having a rear portion, mounted and radially extending from the tubular body;

c) a nock secured to the rear end of the tubular body; and d) a tether connecting the projectile and the penetration limiter;

wherein the one or more flanges extend from a tube slideably mounted onto the tubular body.

4. A penetration limiter for a projectile having a front end and an open rear end which is shot by an archery bow or cross bow, the penetration limiter comprising:

a) a tubular body with a front end and a rear end, the front end being secured to the rear end of the projectile;

b) one or more fletching-like flanges, each having a rear portion, mounted and radially extending from the tubular body;

c) a nock secured to the rear end of the tubular body; and d) a tether connecting the projectile and the penetration limiter;

wherein the one or more flanges extend from a tube removably mounted onto the tubular body.

5. A penetration limiter for a projectile having a front end and an open rear end which is shot by an archery bow or cross bow, the penetration limiter comprising:

a) a tubular body with a front end and a rear end, the front end being secured to the rear end of the projectile;

b) one or more fletching-like flanges, each having a rear portion, mounted and radially extending from the tubular body, wherein the one or more flanges are contoured to engage and not pass through an animal and oriented toward the front end of the projectile;

c) a nock secured to the rear end of the tubular body; and d) a tether connecting the projectile and the penetration limiter.

6. The penetration limiter of claim 5, wherein the tether is slightly longer than the projectile.

7. The penetration limiter of claim 5, wherein the penetration limiter is removably secured to the projectile and such removal is accomplished by inertial forces acting on the projectile as forward motion of the penetration limiter is stopped by an animal.

8. The penetration limiter of claim 7, wherein the tether is slightly longer than the projectile.

9. The penetration limiter of claim 7, wherein the one or more flanges extend from a tube slideably mounted onto the tubular body.

10. The penetration limiter of claim 7 wherein the projectile has a hollow shaft and at least a portion of the tether is placed within the hollow shaft.

11. The penetration limiter of claim 5, wherein the one or more flanges extend from a tube slideably mounted onto the tubular body.

12. The penetration limiter of claim 5, wherein the one or more flanges are flexible.

13. The penetration limiter of claim 5 wherein the projectile has a hollow shaft and at least a portion of the tether is placed within the hollow shaft.

* * * * *